US006422120B1

(12) United States Patent
Bates et al.

(10) Patent No.: US 6,422,120 B1
(45) Date of Patent: Jul. 23, 2002

(54) FIRING MECHANISM FOR A ROTARY MACHINE GUN

(75) Inventors: Peter Arthur Bates, Underhill; Quentan Theodore Sawyer, Milton, both of VT (US)

(73) Assignee: General Dynamics Armament Systems, Inc., Burlington, VT (US)

( * ) Notice: Subject to any disclaimer, the term of this patent is extended or adjusted under 35 U.S.C. 154(b) by 0 days.

(21) Appl. No.: 09/365,811

(22) Filed: Aug. 3, 1999

(51) Int. Cl.[7] ..... F41A 1/00
(52) U.S. Cl. ..... 89/11; 89/28.1
(58) Field of Search ..... 89/11, 12, 27.11, 89/28.1, 127, 135, 13.05; 42/84

(56) References Cited

U.S. PATENT DOCUMENTS

| | | | | | |
|---|---|---|---|---|---|
| 800,663 | A | * | 10/1905 | Meigs et al. | 89/27.3 |
| 812,431 | A | * | 2/1906 | Meigs et al. | 89/27.11 |
| 812,432 | A | * | 2/1906 | Meigs et al. | 89/27.11 |
| 855,427 | A | * | 5/1907 | Bevans | 89/28.1 |
| 925,642 | A | * | 6/1909 | Leech | 89/27.12 |
| 1,087,219 | A | * | 2/1914 | Dawson et al. | 89/28.1 |
| 2,849,921 | A | | 9/1958 | Otto | 89/12 |
| 3,380,343 | A | | 4/1968 | Chiabrandy et al. | 89/12 |
| 3,603,201 | A | * | 9/1971 | Aloi | 89/12 |
| 3,611,871 | A | | 10/1971 | Kirpatrick | 89/127 |
| 3,706,259 | A | * | 12/1972 | Ashley et al. | 89/12 |
| 3,738,221 | A | * | 6/1973 | Tan et al. | 89/12 |
| 4,167,888 | A | * | 9/1979 | Pechamat et al. | 89/11 |
| 4,672,880 | A | * | 6/1987 | Bohler | 89/12 |
| 5,065,662 | A | * | 11/1991 | Bullis et al. | 89/12 |
| 5,413,025 | A | * | 5/1995 | Martin | 89/8 |
| 6,212,990 | B1 | * | 4/2001 | Elspass | 89/28.1 |

* cited by examiner

*Primary Examiner*—Michael J. Carone
*Assistant Examiner*—M. Thomson
(74) *Attorney, Agent, or Firm*—Finnegan, Henderson, Farabow, Garrett & Dunner, L.L.P.

(57) ABSTRACT

A firing mechanism for a rotary machine gun is disclosed. The machine gun includes a housing that rotatably mounts a rotor assembly. The rotor assembly is configured to receive a plurality of ammunition rounds and includes a plurality of firing pins. The firing mechanism includes a percussion system that is disposed on the housing and operates to engage each of the firing pins as the rotor assembly rotates. The percussion system delivers a mechanical force to one of the plurality of ammunition rounds. The firing mechanism further includes an electrical contact that is connected to an electrical power source. The electrical contact is disposed in the housing to contact each of the firing pins as the rotor assembly rotates and to deliver electrical energy to the one ammunition round.

13 Claims, 12 Drawing Sheets

FIRING MECHANISM FOR A ROTARY MACHINE GUN

STATEMENT OF GOVERNMENT INTEREST

The Government has rights in this invention pursuant to Contract W60921-93-D-A105-0011GD awarded by the Department of the Navy.

BACKGROUND OF THE INVENTION

The present invention relates to a firing mechanism for a rotary machine gun. More particularly, the present invention relates to a firing mechanism for a rotary machine gun that can interchangeably fire electrically primed or percussion primed ammunition.

Rotary machine guns are weapons that are designed to fire ammunition at an extremely high rate when compared to other types of weapons. A rotary machine gun includes a series of barrels that are mounted on a rotor assembly. The rotor assembly rotates within a gun housing to fire a round of ammunition from each barrel in rapid succession. As one barrel is being fired, a round is being loaded into another barrel, while a spent casing is extracted from yet another barrel. In this manner, the rotary machine gun achieves the high rate of fire.

Each round of ammunition is fired by igniting a primer contained within the round. There are two commonly used methods of igniting the primer. Some guns use electrical energy to ignite the primer, while other guns use a mechanical force. Accordingly, there are also two types of ammunition: electrically primed and percussion primed. Electrically primed ammunition must be fired with electrical energy and percussion primed ammunition must be fired with a mechanical force.

Certain rotary machine guns, including the 20-mm M-61A1 VULCAN, M-61A2 VULCAN, and M-197 models manufactured by General Dynamics Armament Systems, were designed to use electrically primed ammunition exclusively. These rotary machine guns are commonly used as part of the weapons systems on fighter aircraft. Some of these fighter aircraft are based on aircraft carriers using high-powered electromagnetic devices. It has been discovered that under certain conditions, radiation generated by on-board radar and communications equipment can ignite the electrically primed ammunition. When these conditions occur, the uncontrolled ignition of the 20-mm shells creates a serious safety hazard for those on board the carrier. To eliminate this safety hazard, the carrier-borne aircraft having weapons that require electrically primed ammunition must be retrofitted with weapons capable of firing electrically primed or percussion primed ammunition.

In light of the foregoing there is a need for a mechanism to allow an electrically fired rotary machine gun to fire both electrically primed ammunition and percussion primed ammunition.

SUMMARY OF THE INVENTION

Accordingly, the present invention is directed to a firing mechanism for a rotary machine gun that obviates one or more of the limitations and disadvantages of the prior art rotary machine guns. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a firing mechanism for a rotary machine gun that has a gun housing that rotatably mounts a rotor assembly. The rotor assembly is configured to receive a plurality of ammunition rounds and includes a plurality of firing pins. The firing mechanism includes a percussion system that is disposed on the gun housing. The percussion system is operable to engage and move each of the firing pins as the rotor assembly rotates to deliver a mechanical force to one of the plurality of ammunition rounds. The firing mechanism also includes an electrical contact that is connected to an electrical power source. The electrical contact is disposed in the gun housing to contact each of the firing pins as the rotor assembly rotates. The electrical contact delivers electrical energy to the ammunition round.

In another aspect, the invention is directed to a rotary machine gun that includes a gun housing and a rotor assembly that is rotatably disposed in the gun housing. The rotor assembly is configured to receive a plurality of ammunition rounds and includes a plurality of firing pins. There is provided a percussion system that is disposed on the gun housing. The percussion system is operable to engage and move each of the firing pins as the rotor assembly rotates to deliver a mechanical force to one of the plurality of ammunition rounds. There is further provided an electrical contact that is connected to an electrical power source and is disposed in the gun housing to contact each of the firing pins as the rotor assembly rotates. The electrical contact delivers electrical energy to the ammunition round.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

In accordance with the present invention, a firing mechanism for a rotary machine gun is provided. Rotary machine guns are well known in the art. An example of such a rotary machine gun is disclosed in U.S. Pat. No. 2,849,921 which is hereby incorporated by reference. U.S. Pat. No. 2,849,921 discloses the overall structure and operation of the rotary machine gun and its disclosure of the basic structural components and operation will not be repeated here.

The exemplary embodiment of the present invention is illustrated on an 20-mm m-61A1 model rotary machine gun. It is contemplated that the present invention may also be used with any other rotary machine gun, for example the 20-mm M-61A2 or M-197 rotary machine guns, that are readily apparent to one skilled in the art.

Figure 1:
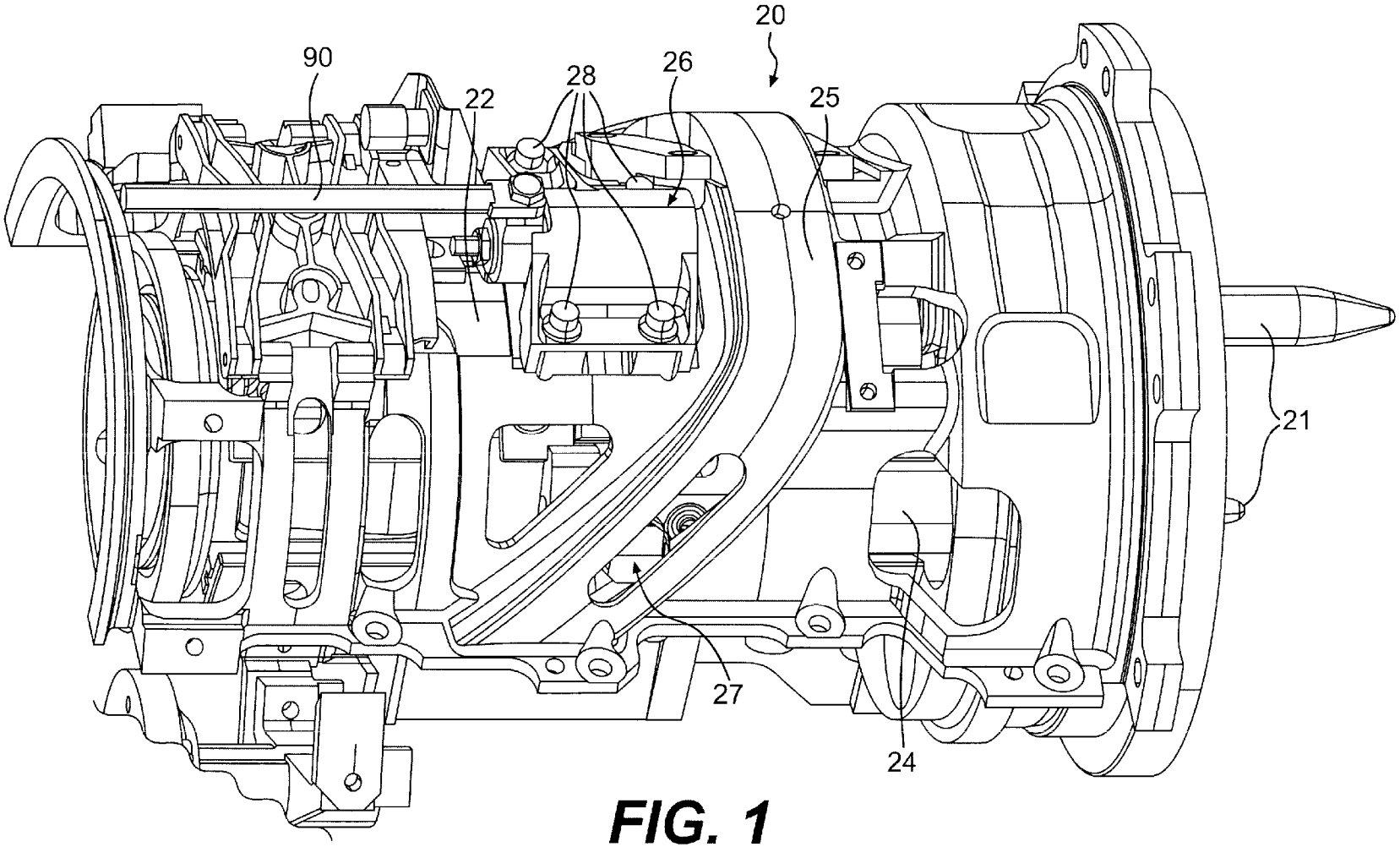
FIG. 1 is a perspective view of a rotary machine gun including a firing mechanism according to the present invention.

An exemplary embodiment of a portion of a rotary machine gun is illustrated in FIG. 1 and is designated generally by reference number 20. The illustrated portion of rotary machine gun 20 includes a stationary cylindrical housing 22 and a rotor assembly 24. Housing 22 also includes a quasi-elliptical track 25 that surrounds housing 22 and an ammunition feeding mechanism (not shown).

The rotor assembly 24 is rotatably disposed within housing 22. Rotor assembly 24 includes a plurality of bolt assemblies 27 (only one of which is illustrated in FIG. 1). Each of the bolt assemblies 27 includes a cam 23 (referring to FIG. 2) that is disposed within track 25 on housing 22. As the rotor assembly rotates, cam 23 follows the quasi-elliptical track 25 and bolt assemblies 27 move between an unlocked position and a locked position.

Referring to FIG. 1, as rotor assembly 24 rotates, rounds of ammunition 21 are fed into the chambers in the rotor assembly when the bolt assemblies are in the rearward, unlocked position. The continued rotation of rotor assembly 24 causes bolt assemblies 27 to follow track 25 and move forwardly to lock the round of ammunition within the chamber.

Figure 2:
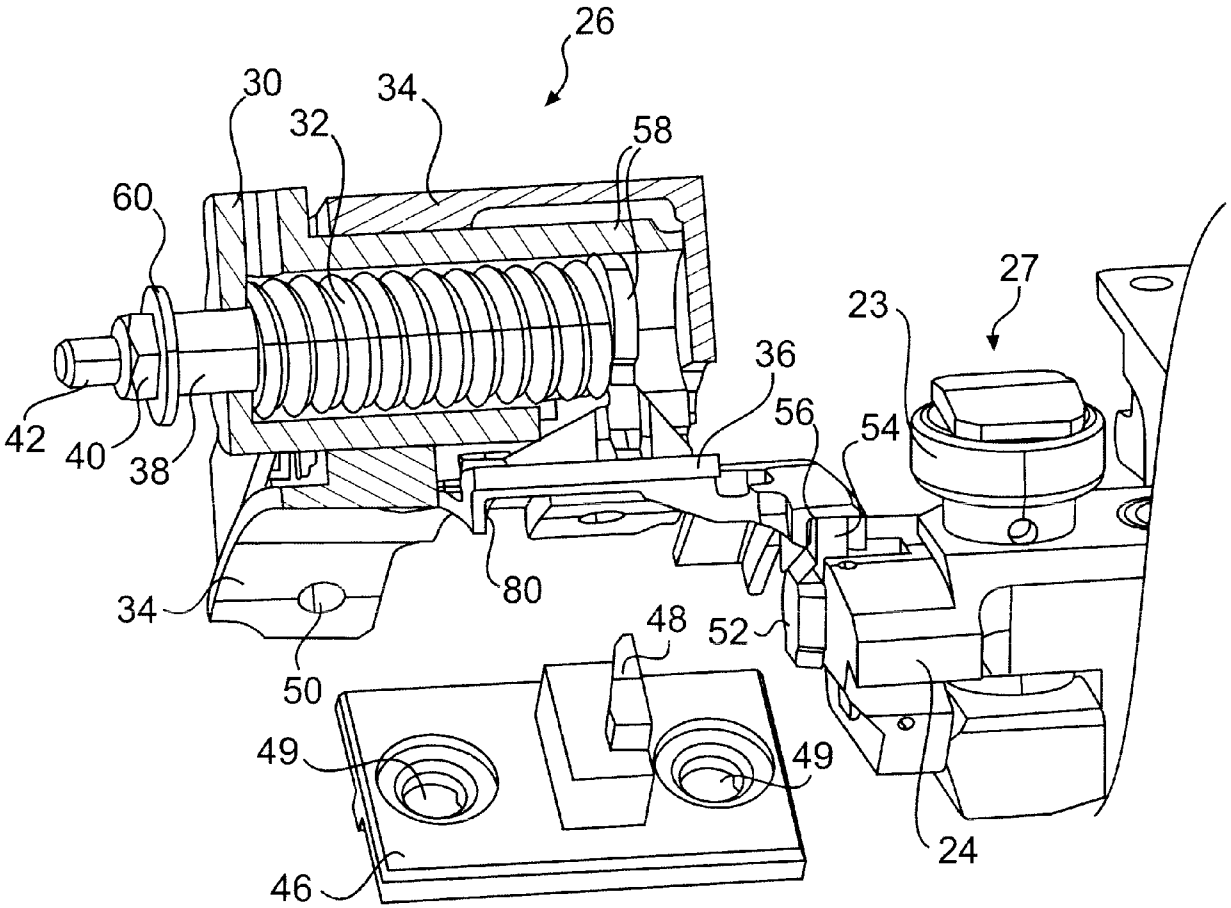
FIG. 2 is a perspective view of a percussion system in accordance with the present invention, illustrating a firing spring in the compressed position.

As shown in FIG. 2, each bolt assembly 27 includes a firing pin 52. Ammunition used in a rotary machine gun may be either electrically primed or percussion primed.

To initiate a round of electrically primed ammunition, electrical energy must be applied through the firing pin to the ammunition round. To initiate a round of percussion primed ammunition, a mechanical force must be applied through the firing pin to the ammunition round.

In accordance with the present invention, a firing mechanism is mounted on the gun housing. The firing mechanism includes a percussion system that delivers a mechanical force to a round of ammunition and an electrical contact that delivers electrical energy to the round of ammunition. Thus, a rotary machine gun that includes the firing mechanism of the present invention may interchangeably initiate both electrically primed and percussion primed ammunition.

As best illustrated in FIG. 1, a percussion system 26 is mounted on gun housing 22. As shown in FIG. 2, percussion system 26 includes a outer spring housing 34 that is connected to gun housing 22. In the exemplary embodiment, spring housing 34 has a series of radial bolt holes 50, only one of which is illustrated in FIG. 2. A set of bolts 28 are disposed through bolt holes 50 to mount percussion system 26 on gun housing 22. The present invention contemplates using any other connecting device that is readily apparent to one skilled in the art to mount percussion system 26 on gun housing 22.

As also shown in FIG. 2, percussion system 26 includes a firing spring 32, a safing housing 30, a rod 38, and a firing cam 36. Firing spring 32 is mounted on rod 38. One end 42 of rod 38 is slidably disposed in an opening in safing housing 30. The other end of rod 38 is connected to a support section 58 of firing cam 36. Rod 38 may be connected to support section 58 of firing cam 36 by any means readily apparent to one skilled in the art.

One side of firing spring 32 engages support piece 58 and the other side engages safing housing 30. In the exemplary embodiment, firing spring 32 is a compression spring that acts to advance firing cam 36 away from safing housing 30. The present invention contemplates that other types of springs, for example tension springs, may also be used to advance the firing cam 36.

Preferably, end 42 of rod 38 is threaded to receive a nut 40. A washer 60 is disposed between nut 40 and safing housing 30. Nut 40 may be tightened against safing housing 30 to draw support piece 58 towards safing housing 30, thereby compressing firing spring 32. In this manner, firing spring 32 may be preloaded to adjust the force exerted by the firing spring on firing cam 36.

Figure 3:
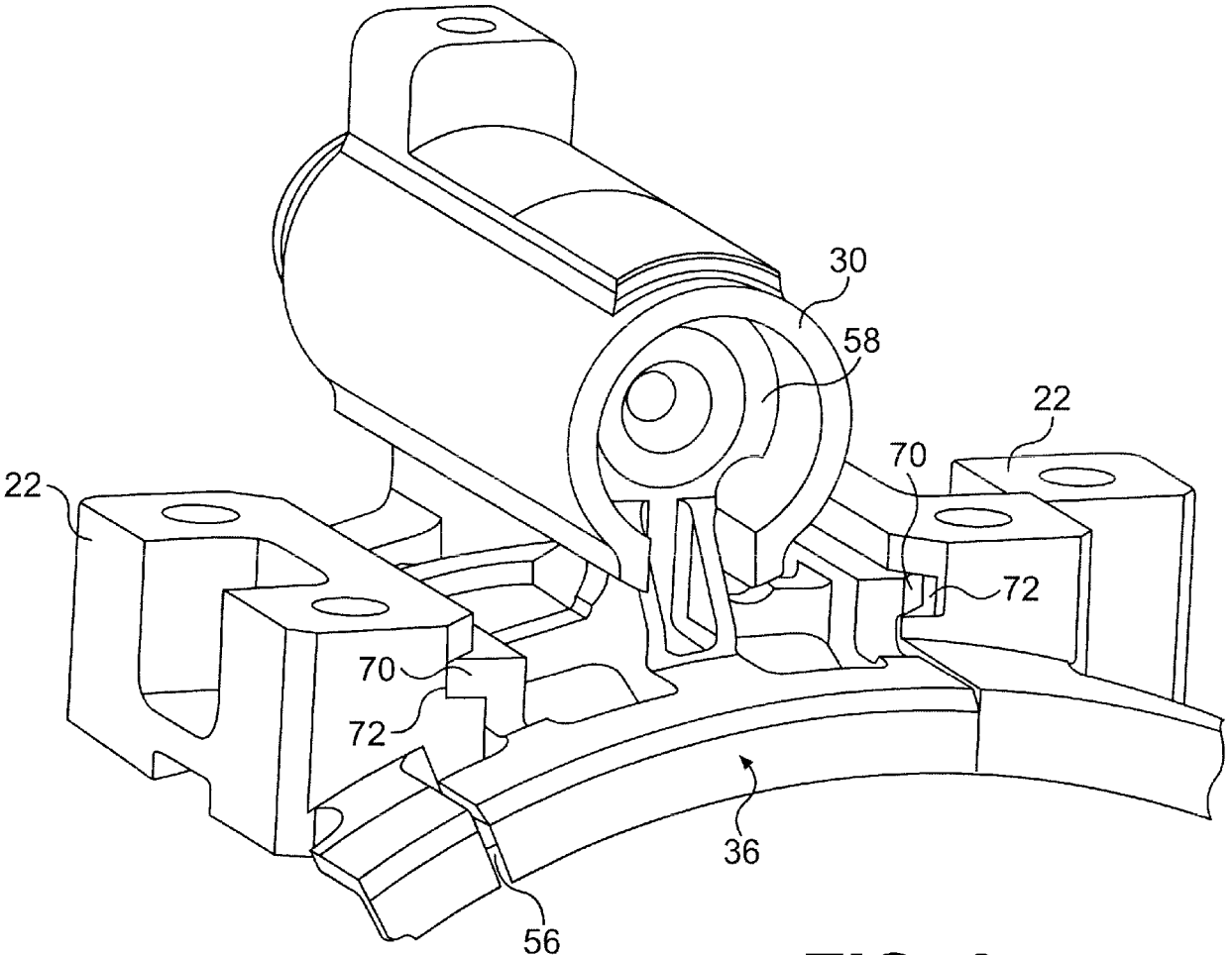
FIG. 3 is a fragmentary perspective view of a safing housing and a firing cam of the present invention.

As shown in FIG. 3, firing cam 36 has two guides 70, each of which are slidably disposed in a trackway 72. Firing cam 36 may slide along trackways 72 between a forward position, as illustrated in FIG. 3, and a rearward position, as illustrated in FIG. 2. In the rearward position, firing spring 32 is compressed. Preferably, the firing cam 36 travels a distance of about 0.295 inches between the forward position and the rearward position to compress firing spring 32.

Figure 4:
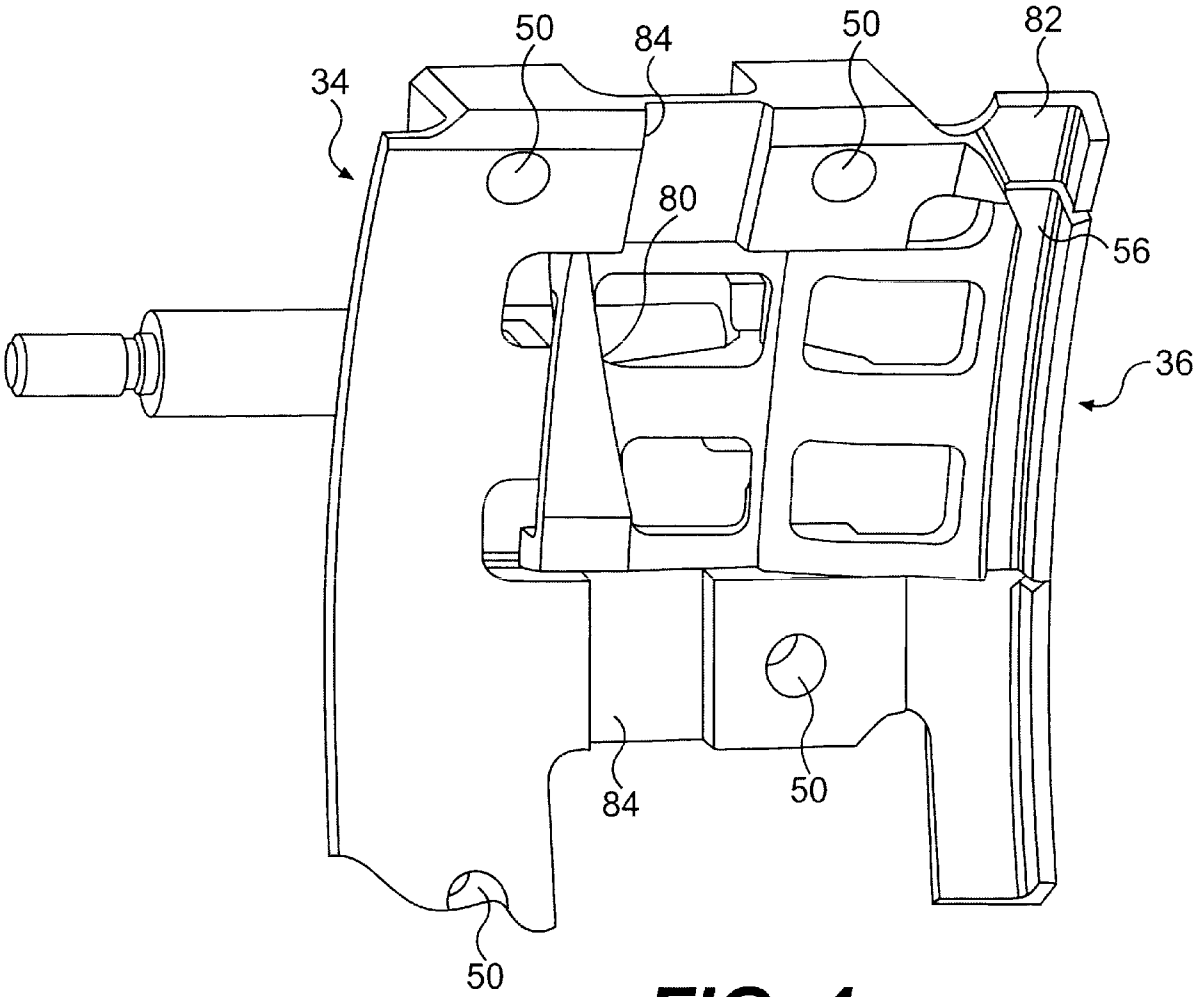
FIG. 4 is a fragmentary perspective view showing the bottom of the firing cam and spring housing of the present invention.

As illustrated in FIG. 4, firing cam 36 also includes a cam surface 80 and a groove 56. When the firing cam 36 is moved to the rearward position, groove 56 aligns with a lead-in area 82 on spring housing 34. As shown in FIG. 2, each firing pin 52 includes a protrusion 54 and groove 56 is configured to engage each protrusion as rotor assembly 24 rotates. When protrusion 54 is engaged with groove 56 and firing cam 36 is moved, the rearward or forward motion of the firing cam is translated to firing pin 52.

In accordance with the present invention, a firing contact is mounted on the rotor assembly. The firing contact engages the percussion system to compress the firing spring. The firing contact then disengages the percussion system, thereby releasing the firing spring to allow the firing spring to advance the firing cam and engaged firing pin to deliver a mechanical force to a round of ammunition.

As illustrated in FIG. 2, firing contact 44 includes a base 46 and a cam contact 48. Two openings 49 are provided in base 46 to mount firing contact 44 on rotor assembly 24. Bolts or any other connecting device readily apparent to one skilled in the art may be used to connect firing contact 44 to rotor assembly 24. Preferably, one firing contact 44 is disposed on rotor assembly 24 for each firing pin 52.

Firing contact 44 is positioned on rotor assembly 24 such that cam contact 48 aligns with cam surface 80 of firing cam 36. As shown in FIG. 4, spring housing 34 includes two grooves 84. Grooves 84 are configured to allow cam contact 48 to rotate through spring housing 34. Cam contact 48 is engageable with cam surface 80 of firing cam 36. Cam contact 48 and cam surface 80 are configured so that the rotation of cam contact 48 past cam surface 80 results in the firing cam 36 moving rearwardly to compress firing spring 32.

As the rotor assembly 24 continues its rotation, cam contact 48 eventually disengages cam surface 80 and firing spring 32 is released. The action of firing spring 32 advances firing cam 36 to the forward, firing position. Preferably, firing spring 32 operates to exert a force of about 21 in-lbs on firing cam 36 and engaged firing pin 52. The force of firing spring 32 on firing cam 36 preferably results in the firing cam 36 and engaged firing pin 52 moving at a velocity of about 240 in/sec when the firing pin strikes the round. This force will ensure that the primer in a percussion primed round of ammunition is ignited.

In accordance with the present invention an electrical contact is provided to deliver electrical energy to a round of ammunition. The electrical contact is connected to an electrical power source that is capable of supplying sufficient electrical energy to discharge an electrically primed round of ammunition.

Figure 11:
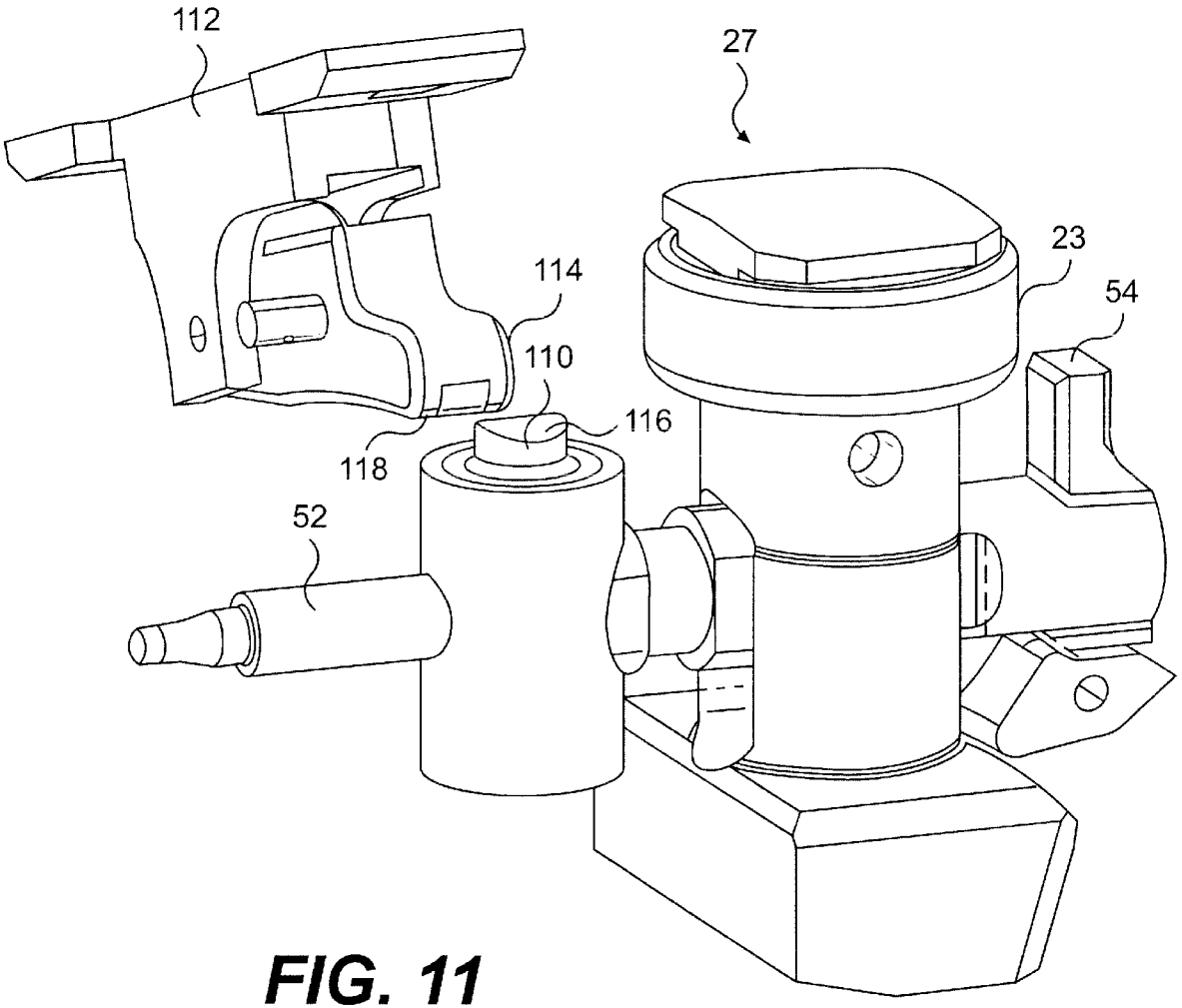
FIGS. 11 and 12 are perspective views of an electrical contact according to the present invention.
Figure 12:
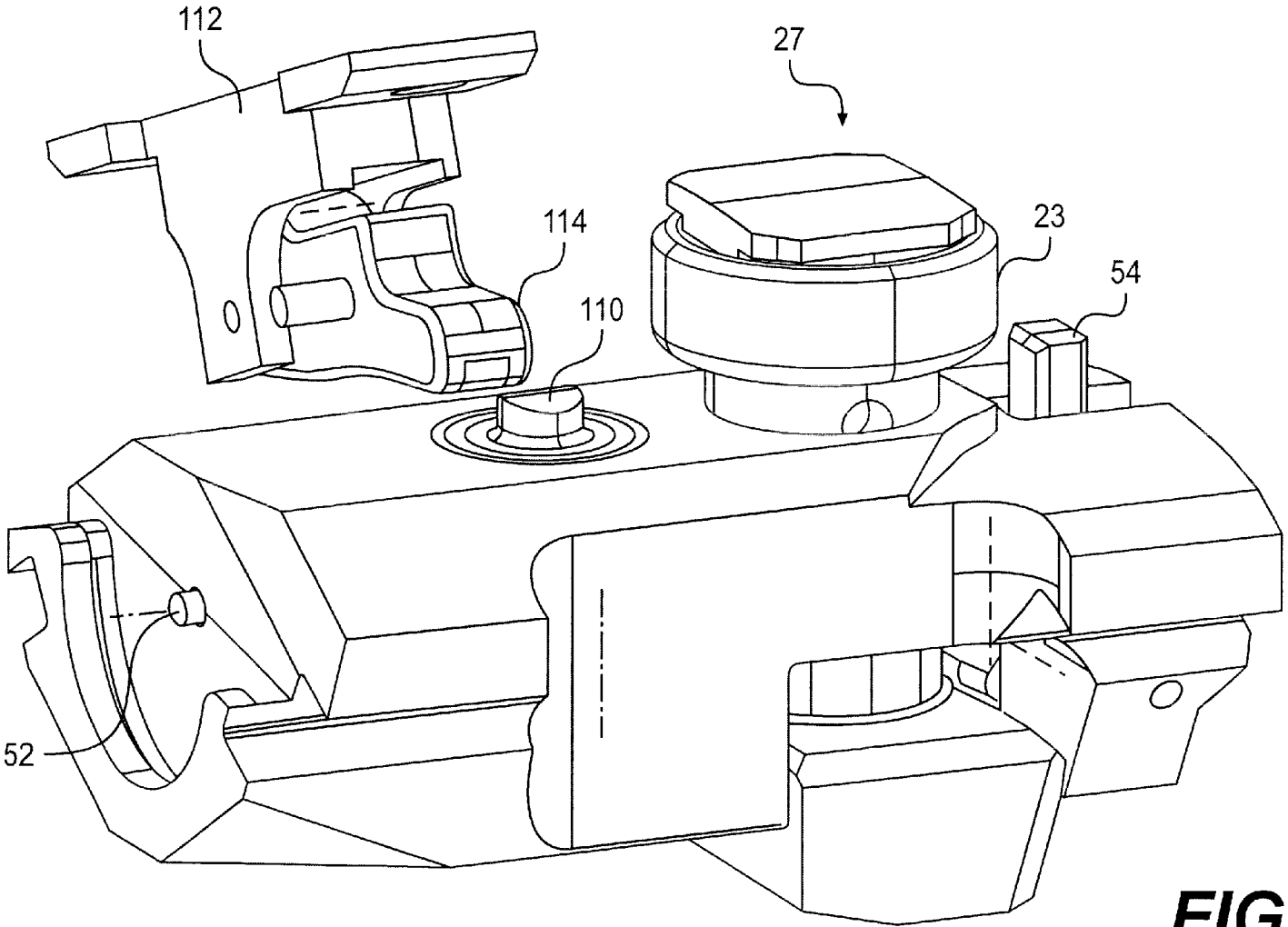

As illustrated in FIGS. 11 and 12, an electrical contact 114 is provided with a mount 112. Mount 112 is connected to the gun housing by bolts or any other readily apparent connecting device. Mount 112 is also connected to an electrical power source (not shown). The electrical energy flows through mount 112 to electrical contact 114.

As also shown in FIGS. 11 and 12, a terminal 110 is provided on each firing pin 52. Terminal 110 on each firing pin 52 is configured to engage electrical contact 114 as the rotor assembly rotates. Preferably, electrical contact 114 includes a rounded edge 118 and terminal 110 includes an angled surface 116 to facilitate the engagement of the electrical contact with the terminal. Mount 112 may include a spring, or another biasing device, to urge electrical contact 114 into engagement with terminal 110.

Engagement of terminal 110 and electrical contact 114 provides an electrical pathway for electrical energy to flow from the power source to the firing pin 52 and, thus, to the round of ammunition when the firing pin is in contact with the ammunition. In this manner, electrical energy is provided to the ammunition to ignite an electrically primed round of ammunition.

Figure 5:
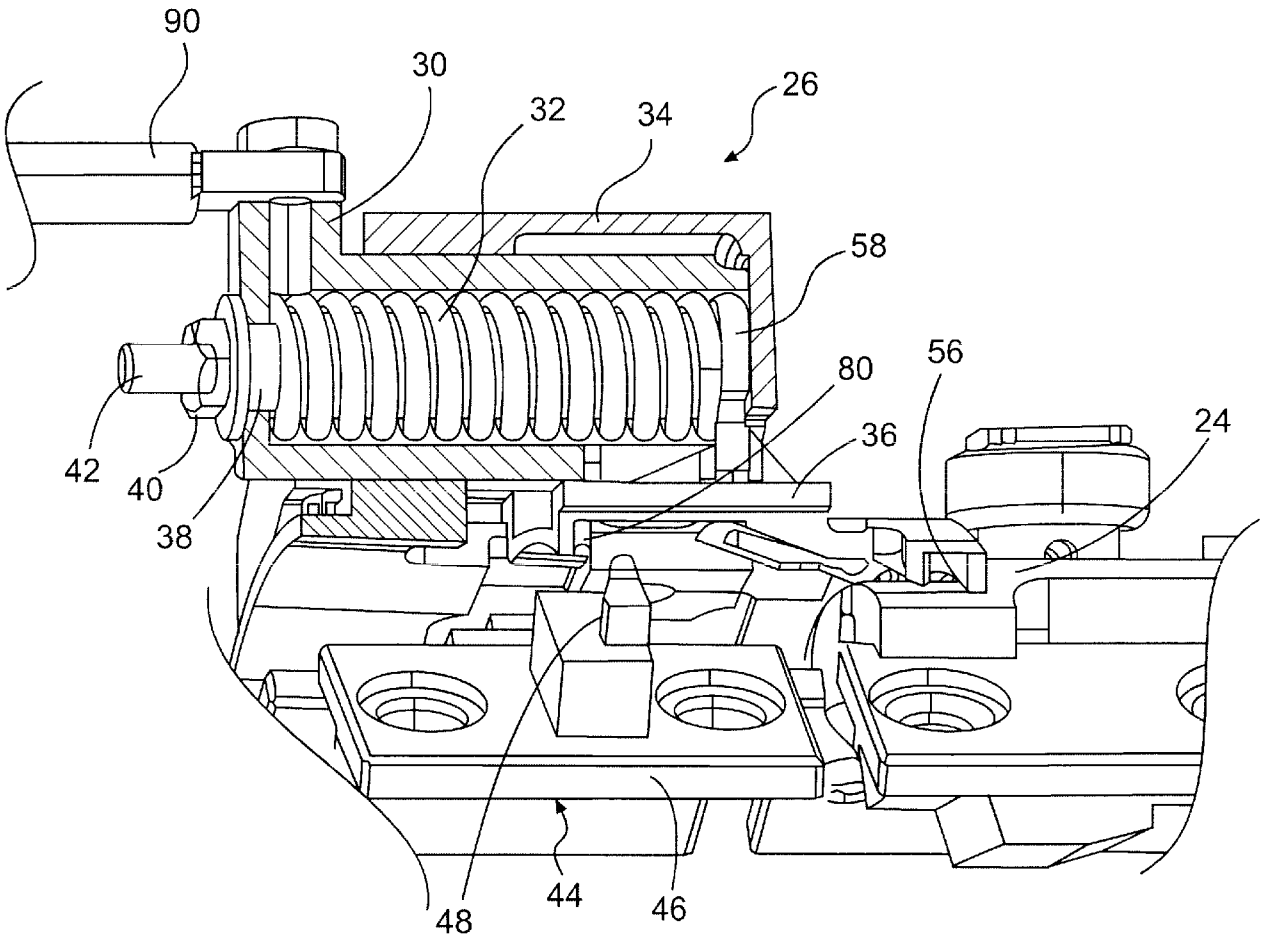
FIG. 5 is a fragmentary perspective view in partial cross-section showing the percussion system of the present invention and illustrating the firing position of the safing housing.

The operation of the aforementioned device will now be described with reference to the attached drawings. As illustrated in FIG. 5, the firing cycle begins as firing contact 44 rotates towards percussion system 26. Firing cam 36 is in the fully forward position and cam contact 48 is aligned with cam surface 80.

Viewing the gun housing as a circle, where 0° is top dead center, cam contact 48 engages cam surface at 310°. The engagement of cam contact 48 and cam surface 80 cause firing cam 36 to move rearwardly to compress firing spring 32. The compression is complete at 332°. The firing cam 36 is now in the full rearward position as illustrated in FIG. 4.

Figure 7:
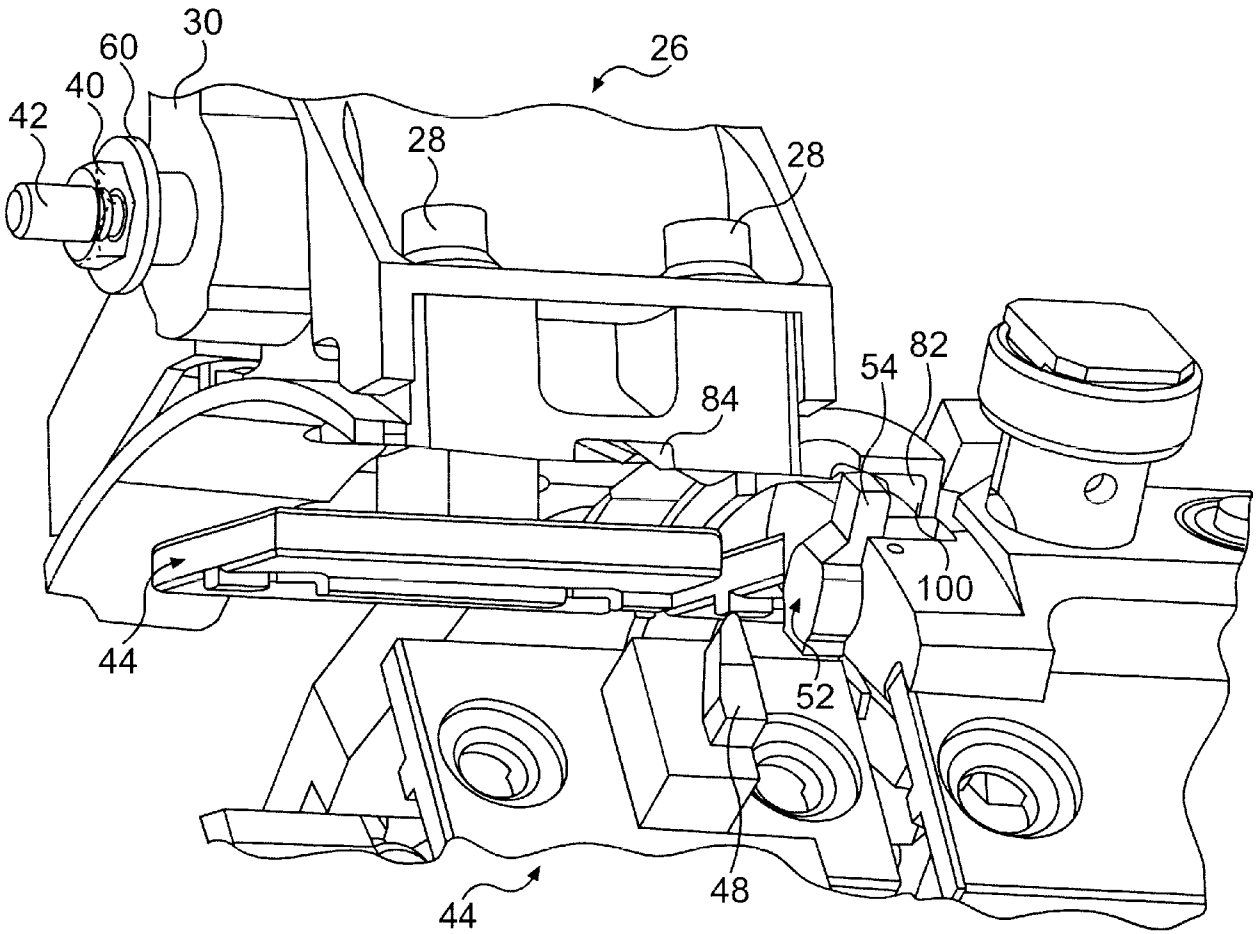
FIG. 7 is a fragmentary perspective view of the percussion system of the present invention, illustrating the firing pin engaging the percussion system.

As illustrated in FIG. 7, firing pin 52 is left in a rearward position by the bolt unlocking mechanism of the rotary machine gun. When firing pin 52 reaches 326°, protrusion 54 enters a lead-in area 82 of spring housing 34. Lead-in area 82 is configured to correct any misalignment of firing pin 52 and guide protrusion 54 into firing cam groove 56. Shoulder 100 of lead-in area 82 prevents protrusion 54 from moving forwardly. This will prevent firing pin 52 from striking the round of ammunition during the bolt locking operation of the rotary machine gun.

Figure 8:
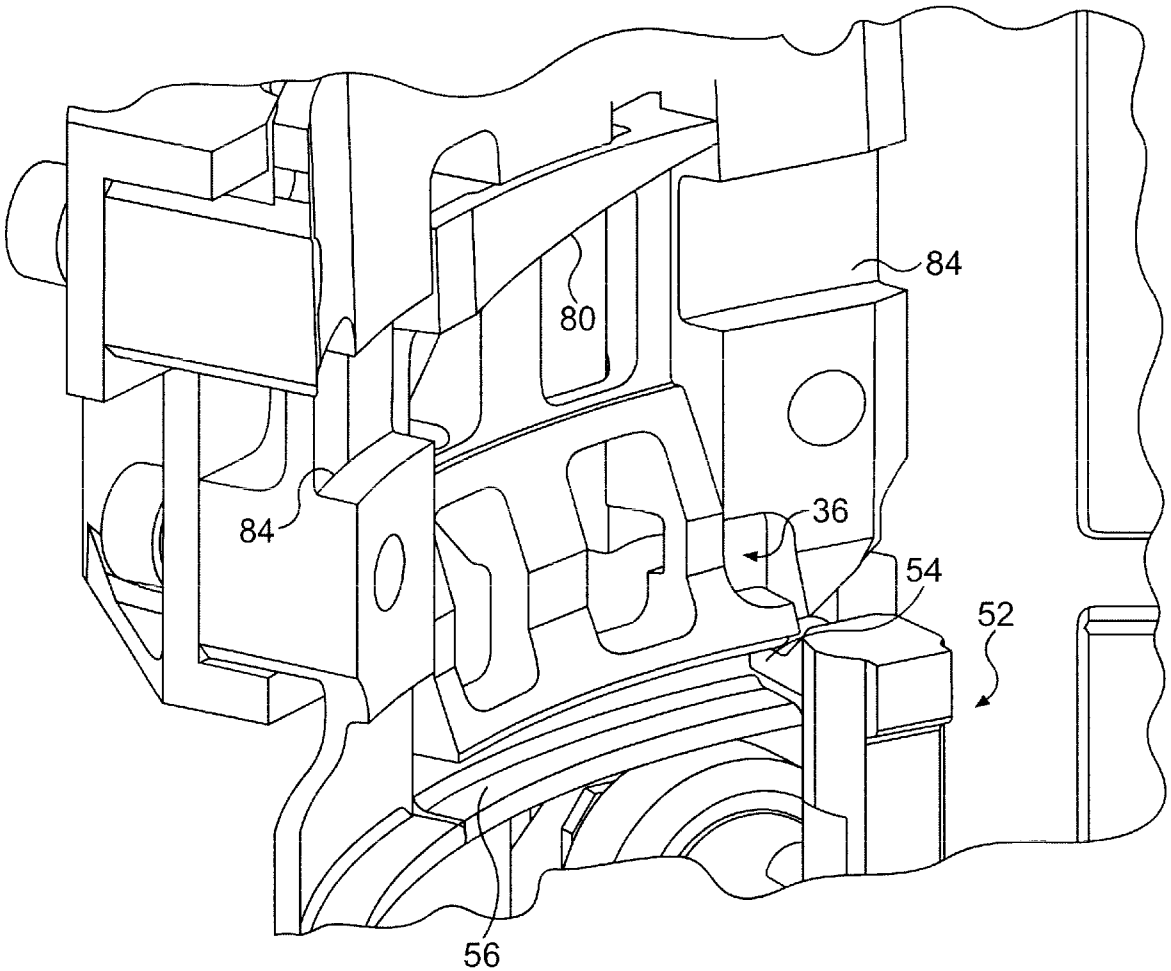
FIG. 8 is a fragmentary perspective view showing the bottom of the percussion system of FIG. 7, and illustrating the firing pin engaging the firing cam.

As shown in FIG. 8, protrusion 54 is guided into groove 56 of firing cam 36 when firing cam 36 is in the rearward position and firing spring 32 is compressed. Protrusion 54 enters groove 56 at 334°. Percussion system 26 is now cocked.

Figure 9:
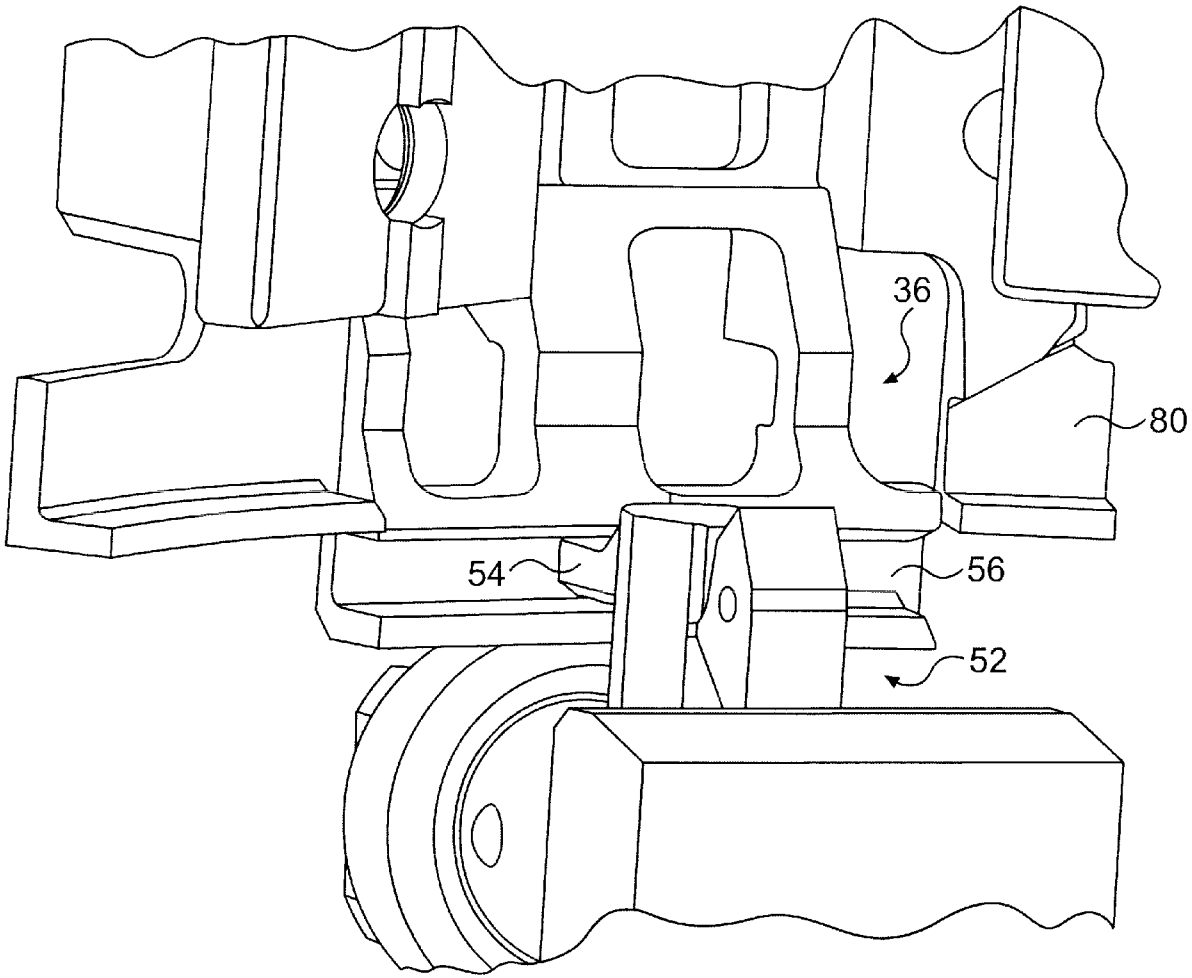
FIG. 9 is a fragmentary perspective view showing the bottom of the percussion system of FIG. 7, and illustrating the firing cam in the forward, firing position.

Cam contact 48 disengages cam surface 80 of firing cam 36 to release compressed firing spring 32 when firing pin 52 is at 338°. Firing spring 32 acts on firing cam 36 to advance firing pin 52 forwardly, as illustrated in FIG. 9. This motion causes firing pin to strike the round of ammunition to deliver a mechanical force to ignite a percussion primed round of ammunition.

Protrusion 54 of firing pin 52 remains engaged with groove 56 and firing pin 52 remains in contact with the round of ammunition until the firing pin rotates to 8°. While firing pin 52 is engaged with the round of ammunition, terminal 110 rotates into engagement with electrical contact 114. This engagement provides an electrical connection between the electrical power source and the ammunition round. Thus, electrical energy is delivered to the round of ammunition to ignite electrically primed ammunition.

The engagement of protrusion 54 and groove 56 ensures that a constant force is exerted on firing pin 52 after firing to prevent primer blowback. In addition, the preload on firing spring 32 also exerts a force on firing cam 36 and firing pin 52 to oppose any recoil or counter recoil force exerted on the firing pin.

Figure 10:
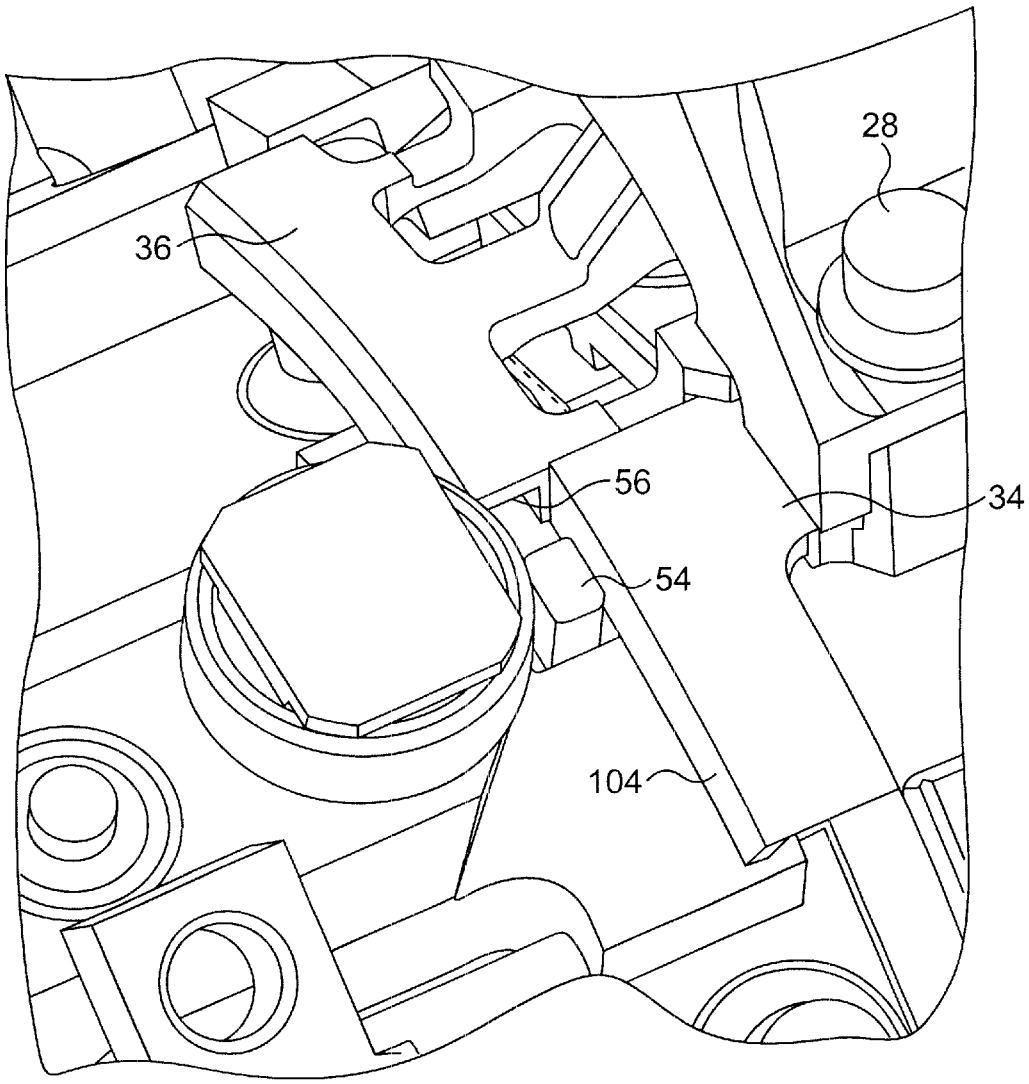
FIG. 10 is a perspective view of the percussion system of FIG. 7, and illustrating the firing pin exiting the percussion system.

As illustrated in FIG. 10, protrusion 54 of firing pin 52 transitions from groove 56 to an outer surface 104 of spring housing 34. Outer surface 104 also prevents firing pin 52 from moving as a result of primer blowback. Outer surface 104 maintains control over firing pin 52 until firing pin 52 rotates into the bolt unlocking section of the rotary machine gun. Thus, the firing mechanism of the present invention maintains complete control of the firing pin during the entire firing cycle.

This firing cycle is repeated for each barrel of the rotary machine gun as it rotates through the firing cycle. As illustrated in FIG. 7, after one firing contact 44 rotates through percussion system 26, another firing contact 44 is preparing to engage the percussion system.

Figure 6:
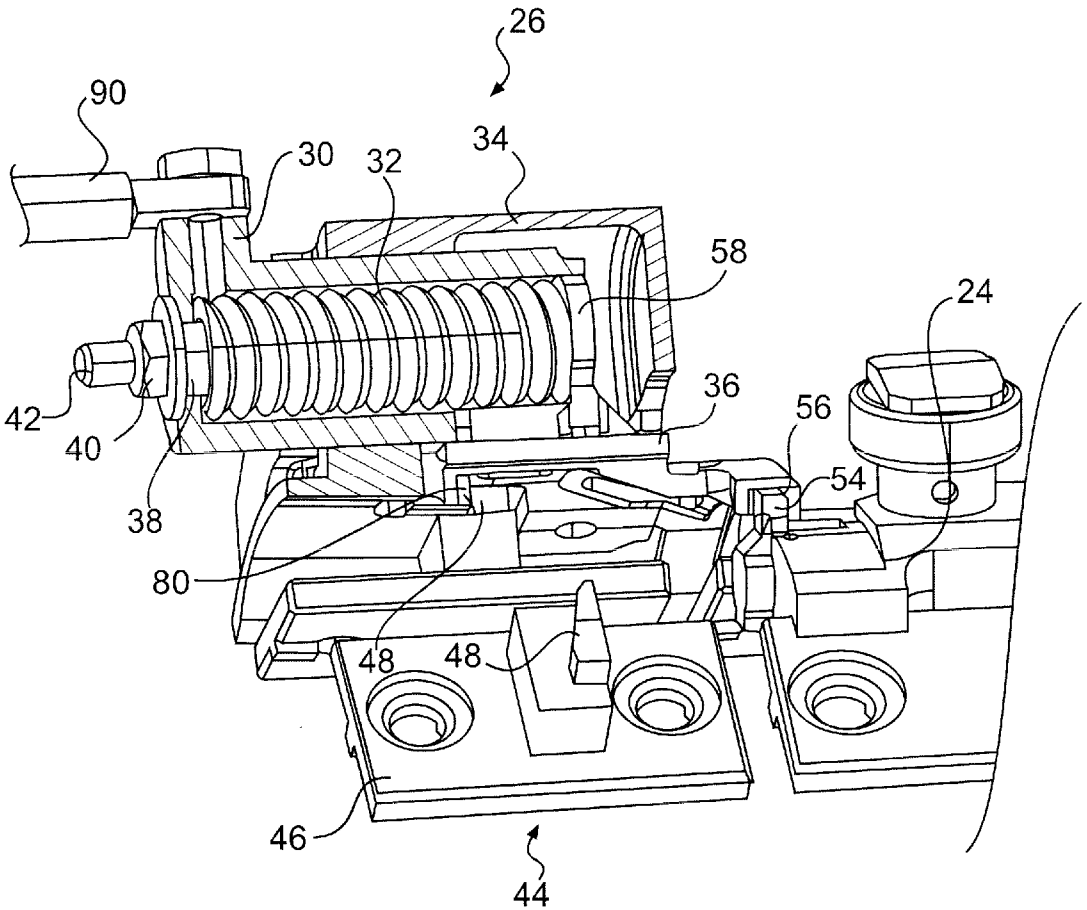
FIG. 6 is a fragmentary perspective view in partial cross-section showing the percussion system of FIG. 5 and illustrating the safe position of the safing housing.

In accordance with the present invention, the firing mechanism of the present invention also includes a safety device. As illustrated in FIGS. 5 and 6, a safing housing 30 is slidably disposed in spring housing 34. As illustrated in FIG. 5, a safing handle 90 is connected to safing housing 30. Safing handle 90 may be operated to slide safing housing 30 within spring housing 34 from the firing position illustrated in FIG. 5 to a safe position as illustrated in FIG. 6.

As illustrated in FIG. 6, because safing housing 30 supports one end of firing spring 32, the movement of safing housing 30 within spring housing 34 does not compress firing spring 32. In addition, when safing housing 30 is in the safe position, firing cam 36 is moved to its rearward position. In the rearward position, cam contact 48 will rotate through the firing mechanism without engaging cam surface of firing cam 36. Thus, firing spring 32 remains uncompressed when safing housing 30 is in the safe position. Since firing spring 32 is not compressed the possibility of delivering energy to the firing pin is eliminated. Thus, the safety device prevents the firing pin from any contact with a chambered round, thereby preventing a transfer of mechanical energy to the chambered round.

In addition, when safing housing 30 is in the safe position, groove 56 is aligned to engage protrusion 54 of firing pin 52. Groove 56 will control the motion of firing pin 52 throughout the firing cycle to further prevent the firing pin from moving forwardly to engage a round of ammunition. In addition, since firing pin 52 does not move forwardly in bolt assembly 27, terminal 110 does not engage electrical contact 114. Therefore, no electrical energy is applied to the round of ammunition. In this manner, the safety device of the present invention maintains complete control of the firing pin to prevent the ignition of either percussion primed or electrically primed ammunition.

It will be apparent to those skilled in the art that various modifications and variations can be made in the construction of this percussion firing mechanism without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A firing mechanism for a rotary machine gun having a housing and a rotor assembly rotatably disposed in said housing, the rotor assembly configured to receive a plurality of ammunition rounds and including a plurality of firing pins, each of said firing pins having a terminal, the mechanism comprising:

a percussion system disposed on said housing and operable to selectively engage a selected one of said firing pins, the percussion system including a firing spring configured to act on the selected one of said firing pins to advance said selected firing pin to deliver a mechanical force to one of the plurality of ammunition rounds, said firing spring mounted on a rod having a threaded portion and a nut engageable with said threaded portion of said rod to preload said firing spring; and an electrical contact connected to an electrical power source, said electrical contact disposed in said housing to selectively engage the terminal of each of said firing pins as said rotor assembly rotates, said electrical contact transmitting electrical energy through the selected one of said firing pins to said one ammunition round after said percussion system has moved said selected one firing pin into contact with said one ammunition round.

2. The mechanism of claim 1, further comprising a firing contact mounted on said rotor assembly, said firing contact engaging said percussion system as said rotor assembly rotates to compress said firing spring and subsequently release said firing spring.

3. The mechanism of claim 2, wherein the percussion system includes a firing cam connected to said firing spring, said firing contact engaging said firing cam to compress said firing spring as said rotor assembly rotates.

4. The mechanism of claim 3, wherein the firing cam has a groove configured to engage said protrusion on each firing pin as said rotor assembly rotates.

5. The mechanism of claim 3, wherein said percussion system includes trackways for slidably mounting said firing cam.

6. A firing mechanism for a rotary machine gun having a housing and a rotor assembly rotatably disposed in said housing, the rotor assembly configured to receive a plurality of ammunition rounds and including a plurality of firing pins, the mechanism comprising:

a firing cam configured to engage a selected one of said firing pins as said rotor assembly rotates;

a firing spring operatively connected to the firing cam and acting on the firing cam to bias the selected firing pin into contact with one of the plurality of ammunition rounds;

a firing contact mounted on said rotor assembly and configured to engage said firing cam as said rotor assembly rotates to compress said firing spring and subsequently release said firing spring;

a safing housing connected to the firing cam and moveable between a safe position where said firing contact bypasses said firing cam and a firing position where said firing contact engages said firing cam; and an electrical contact connected to an electrical power source, said electrical contact disposed in said housing to contact each of said firing pins as said rotor assembly rotates to deliver electrical energy to said one ammunition round.

7. The mechanism of claim 6, wherein the percussion system includes a safing handle connected to said safing housing to move said safing housing between said firing and safe positions.

8. A rotary machine gun, comprising:

a housing;

a rotor assembly rotatably disposed in said housing and configured to receive a plurality of ammunition rounds, the rotor assembly including a plurality of firing pins, each of said firing pins including a terminal;

a percussion system disposed on said housing and operable to selectively engage a selected one of said firing pins, the percussion system including a firing spring configured to act on the selected one of said firing pins to advance said selected firing pin to deliver a mechanical force to one of the plurality of ammunition rounds, said firing spring mounted on a rod having a threaded portion and a nut engageable with said threaded portion of said rod to preload said firing spring; and an electrical contact connected to an electrical power source, said electrical contact disposed in said housing to selectively engage the terminal of each of said firing pins as said rotor assembly rotates, said electrical contact transmitting electrical energy through the selected one of said firing pins to said one ammunition round after said percussion system has moved said selected one firing pin into contact with said one ammunition round.

9. The rotary machine gun of claim 8, further comprising a firing contact mounted on said rotor assembly, said firing contact engaging said percussion system as said rotor assembly rotates to compress said firing spring and subsequently release said firing spring.

10. The rotary machine gun of claim 9, wherein the percussion system includes a firing cam connected to said firing spring, said firing contact engaging said firing cam to compress said firing spring as said rotor assembly rotates.

11. The rotary machine gun of claim 10, wherein the firing cam has a groove configured to engage said protrusion on each firing pin as said rotor assembly rotates.

12. The rotary machine gun of claim 10, wherein said percussion system includes trackways for slidably mounting said firing cam.

13. A firing mechanism for a rotary machine gun having a housing and a rotor assembly rotatably disposed in said housing, the rotor assembly configured to receive a plurality of ammunition rounds and including a plurality of firing pins, the mechanism comprising:

a percussion system disposed on said housing and operable to selectively engage a selected one of said firing pins, the percussion system including a firing spring configured to act on the selected one of said firing pins to advance said selected firing pin to deliver a mechanical force to one of the plurality of ammunition rounds, a firing cam connected to said firing spring, and a pair of trackways for slidably mounting said firing cam;

a firing contact mounted on said rotor assembly, said firing contact engaging said firing cam to compress said firing spring as said rotor assembly rotates, wherein said firing cam travels a distance of about 0.295 inches to compress said firing spring; and an electrical contact connected to an electrical power source, said electrical contact disposed in said housing to contact each of said firing pins as said rotor assembly rotates to deliver electrical energy to said one ammunition round.

* * * * *